US005485130A

United States Patent [19]

Nakahara et al.

[11] Patent Number: 5,485,130

[45] Date of Patent: Jan. 16, 1996

[54] MICROWAVE SWITCH CIRCUIT AND AN ANTENNA APPARATUS

[75] Inventors: Kazuhiko Nakahara; Takuo Kashiwa, both of Itami, Japan

[73] Assignee: Mitsubishi Denki Kabushiki Kaisha, Tokyo, Japan

[21] Appl. No.: 378,876

[22] Filed: Jan. 24, 1995

Related U.S. Application Data

[63] Continuation of Ser. No. 162,307, Dec. 6, 1993, abandoned.

[30] Foreign Application Priority Data

Jan. 29, 1993 [JP] Japan ..... 5-013064

[51] Int. Cl.[6] ..... H01P 1/15

[52] U.S. Cl. ..... 333/104; 333/262

[58] Field of Search ..... 333/103, 104, 333/164, 262; 307/571; 327/427

[56] References Cited

U.S. PATENT DOCUMENTS

| | | | |
|---|---|---|---|
| 4,637,073 | 1/1987 | Selin et al. | 333/103 X |
| 4,789,846 | 12/1988 | Matsunaga et al. | 333/104 |

FOREIGN PATENT DOCUMENTS

| | | | |
|---|---|---|---|
| 409374 | 3/1990 | European Pat. Off. . | |
| 5055803 | 3/1993 | European Pat. Off. . | |
| 62-97403 | 5/1987 | Japan . | |
| 63-87901 | 6/1988 | Japan . | |
| 63-197101 | 8/1988 | Japan . | |
| 22211 | 1/1992 | Japan | 333/103 |

OTHER PUBLICATIONS

Matsunaga et al, "High–Power Microwave Transmit–Receive Switch With Series And Shunt GaAs FETs", IEICE Trans. Electron., vol. E75–C, No. 2, Feb. 1992, pp. 252–258.

Matsunaga et al, "An X–Band 12W GaAs Monolithic Transmit–Receive Switch", The Transactions of the IEICE, vol. E70, No. 4, Apr. 1987, pp. 259–260.

Danny T. Bryant, "A Monolithic Reduced–Size Ku–Band SPDT Switch", IEEE MTT–S Digest, 1988, pp. 371–374.

Bernkopf et al, "A High Power K/Ka–Band Monolithic T/R Switch", IEEE 1991 Microwave and Millimeter–Wave Monolithic Circuits Symposium, pp. 15–18.

Pengelly et al, "Transmit–Receive Module Using GaAs ICs", Electrical Engineering, Nov. 1984, pp. 141–149.

*Primary Examiner*—Paul Gensler
*Attorney, Agent, or Firm*—Leydig, Voit & Mayer

[57] ABSTRACT

A microwave switch circuit includes a first impedance conversion circuit, one end of which is connected to an input terminal; a resonance circuit connected between an output of the first impedance conversion circuit and ground and including a parallel connection of a field effect transistor and a resonance inductor; and a second impedance conversion circuit connected between the output of the first impedance conversion circuit and an output terminal. One microwave switch circuit may be connected between an antenna terminal and a signal input terminal and another microwave switch circuit may be connected between the antenna terminal and a signal receiving terminal. The microwave switch circuit output terminal and input terminal may have an impedance of 50 Ω and the output of the first impedance conversion circuit may have an impedance lower than 50 Ω. The microwave switch circuit may include one-fourth wavelength transmission lines as the first and second impedance conversion circuits. Consequently, the maximum allowable value of the incident power is increased and withstand power is increased in an antenna switch circuit.

4 Claims, 10 Drawing Sheets

MICROWAVE SWITCH CIRCUIT AND AN ANTENNA APPARATUS

This disclosure is a continuation of application Ser. No. 08/162,307, filed Dec. 6, 1993, now abandoned.

FIELD OF THE INVENTION

The present invention relates to a microwave switch circuit and an antenna apparatus, more particularly, to a switch circuit employing a resonance circuit comprising a field effect transistor (referred to as FET, hereinafter) and an inductor, and an impedance conversion circuit, and an antenna apparatus using this microwave switch circuit.

PRIOR ART

Conventionally, microwave switch circuits are each include a resonance circuit comprising an FET and an inductor and a transmission line. FIG. 7 shows an example of a prior art microwave switch circuit. In the figure, reference numeral 15 designates an input terminal and reference numeral 16 designates an output terminal. A transmission line 14 is connected between the input terminal 15 and the output terminal 16. FETs *7a*, *7b* are provided at the input terminal side and the output terminal side of the transmission line 14, respectively. Reference numerals *6a* and *6b* designate gate bias terminals of the FETs, respectively. Resonance inductors 8a and 8b are connected with the FETs *7a* and *7b*, respectively. A 50 Ω terminating resistor 17 is inserted between the resonance circuit comprising the input terminal side FET *7a* and the resonance inductor *8a*, and the ground. The switch circuit of this construction functions to control the transmission of the signal input from the input terminal 15 by turning on or off the bias to the gate bias terminals *6a* and *6b* of the FETs *7a* and *7b*.

The operation of this switch circuit will be described.

FIG. 8 shows an equivalent circuit of the switch circuit of FIG. 7 in a case where a gate bias is applied to the gate bias terminal 6 at the both of the input side and the output side, i.e., in a state where both FETs *7a* and *7b* are in off states. When FETs 7 are in off states, resonance circuits are produced by the off capacitances 9 of the FETs 7 due to the depletion layers thereof and the resonance inductors 8. Then, the impedances viewed from the points C and D towards the FETs, i.e., the ground, are infinite at microwave frequencies. Then, the signal at the input terminal 15 is transmitted through the transmission line 14 to the output terminal 16.

On the other hand, FIG. 9 shows an equivalent circuit where both FETs 7 are in on states. Then, the FETs 7 are represented by the on resistances 10 which are resistances of the operating layers of the FETs 7 in on states. Then, the microwave energy is absorbed by the resistor 17 from the point C and is not transmitted to the output terminal 16. That is, the whole switch circuit is in off state.

FIG. 10 shows an equivalent circuit of the FET 7. Reference numerals 8 and 9 in the figure represent the above-described resonance inductor and off capacitance, respectively. Reference numeral 18 designates gate to drain resistance $R_{gd}$, reference numeral 19 designates gate to drain capacitance $C_{gd}$, reference numeral 20 designates gate to source capacitance $C_{gs}$, and reference numeral 21 designates gate to source resistance. FIG. 11 shows a voltage applied between drain and source of the FET 7 when microwave enters from the input terminal 15. As can be seen from the figure, this voltage is a sinusoidal wave of an amplitude of $V_{dsRF}/2$. Then, this voltage is divided by the gate bias terminal 6. The voltage applied between the gate and drain then is represented as $V_{gRF}$ in FIG. 12. Here, when a negative voltage is applied to the gate bias terminal 6 of the FET 7, the voltage $V_{gRF}$ is shifted by $-V_{gbias}$ relative to the gate voltage vs current characteristic as shown in the figure. Therefore, the voltage $V_{gRF}$ locally reaches the breakdown voltage $V_{br}$ of the FET 7.

On the other hand, the allowable maximum value of power that can be applied to the FET 7 is represented by the following formula;

$$P_{max} = \frac{2\,(V_g - V_{br})^2}{Z}$$

where $V_g$: gate bias voltage applied to the FET 7

$V_{br}$: breakdown voltage of the FET 7

Z: characteristic impedance of the transmission line of a portion connected to the FET 7 (point E in FIG. 10).

In the microwave switch circuit having the above-described structure, the power applied to this microwave switch circuit is regulated by the gate bias voltage $V_g$ and the breakdown voltage $V_{br}$ of the FET, and therefore when an excessively large power is applied to this switch circuit, the gate voltage $V_g$ exceeds the breakdown voltage $V_{br}$, thereby destroying the FET. In addition, it is neither easy to improve the breakdown voltage nor difficult to improve the withstand power of the switch.

SUMMARY OF THE INVENTION

It is an object of the present invention to provide a microwave switch circuit that improves the withstand power of the switch circuit employing the same FET as in the prior art.

It is another object of the present invention to provide an antenna apparatus using this microwave switch circuit.

Other objects and advantages of the present invention will become apparent from the detailed description given hereinafter; it should be understood, however, that the detailed description and specific embodiment are given by way of illustration only, since various changes and modifications Within the spirit and scope of the invention will become apparent to those skilled in the art from this detailed description.

According to a first aspect of the present invention, a microwave switch circuit includes an impedance conversion circuit inserted between an input terminal and an FET and another impedance conversion circuit inserted between the FET and an output terminal so as to lower the impedance where the FET is connected to a transmission line.

Therefore, the impedance of the portion connected to the FET part can be lowered, resulting in an improved withstand power of a switch circuit.

According to a second aspect of the present invention, the microwave switch circuit is provided between an antenna side terminal and a transmission wave input terminal in an antenna apparatus.

According to a third aspect of the present invention, a pair of microwave switch circuits is provided, one of which is provided between an antenna side terminal and a transmission wave input terminal and the other of which is provided between the antenna side terminal and the receiving wave output terminal in an antenna apparatus.

According to a fourth aspect of the present invention, a microwave switch circuit includes an output terminal and an input terminal, has an impedance of 50 Ω, and an output end of a first impedance conversion circuit having an output impedance lower than 50 Ω.

In addition, according to a fifth aspect of the present invention, a microwave switch circuit includes one-fourth wavelength transmission lines as the first and the second impedance conversion circuits.

In this case, the maximum allowable incident power can be increased and the withstand power can be increased in an antenna switch circuit.

DETAILED DESCRIPTION OF THE PREFERRED EMBODIMENTS

Embodiment 1

Figure 1:
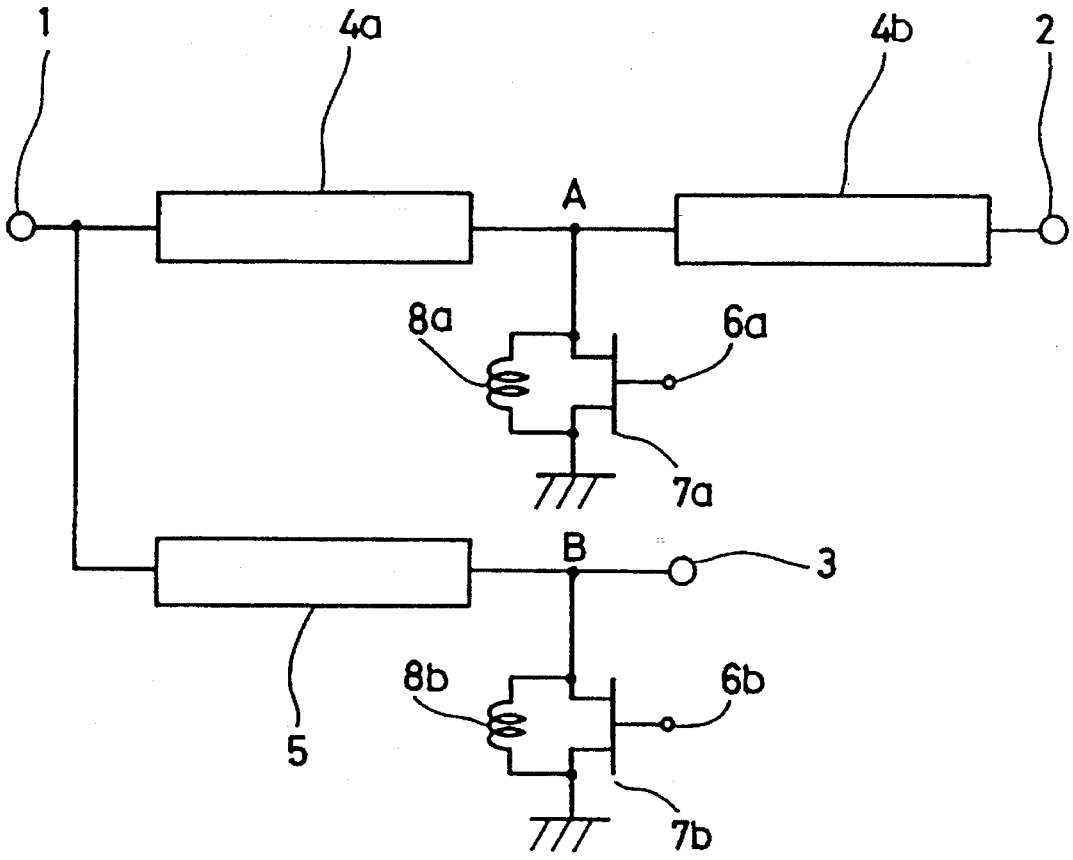
FIG. 1 illustrates a microwave switch circuit according to a first embodiment of the present invention.

FIG. 1 is a diagram illustrating a circuit of a transmitting and receiving switch in an antenna apparatus employing a microwave switch circuit according to a first embodiment of the present invention.

In the figure, reference numeral 1 designates an antenna side terminal, reference numeral 2 designates a transmission wave input terminal, and reference numeral 3 designates a receiving wave output terminal. A one-fourth wavelength transmission line 5 is connected to the antenna side terminal 1 at its one end and is connected to the receiving output terminal 3 at its other end. A first impedance converter *4a* comprising a one-fourth wavelength line is connected to the antenna side terminal 1 at its one end and to the point A of low impedance at its other end. A second impedance converter *4b* comprising a one-fourth wavelength line is connected to the point A of low impedance at its one end and to the transmission wave input terminal 2 at its other end. Here, the respective characteristic impedances of the one-fourth wavelength transmission line 5 and the first and the second impedance converters *4a* and *4b* are such that the characteristic impedance of the one-fourth wavelength transmission line 5 at the receiving side is 50 Ω, the impedance of the point A is 12.5 Ω, and the characteristic impedances of the first and the second impedance converters *4a* and *4b* are 25 Ω from a calculation using the impedances.

In addition, reference numerals *6a*, *6b*, *7a*, *7b*, *8a*, and *8b* are gate bias terminals, FETs, and resonance inductors, respectively.

Figure 2:
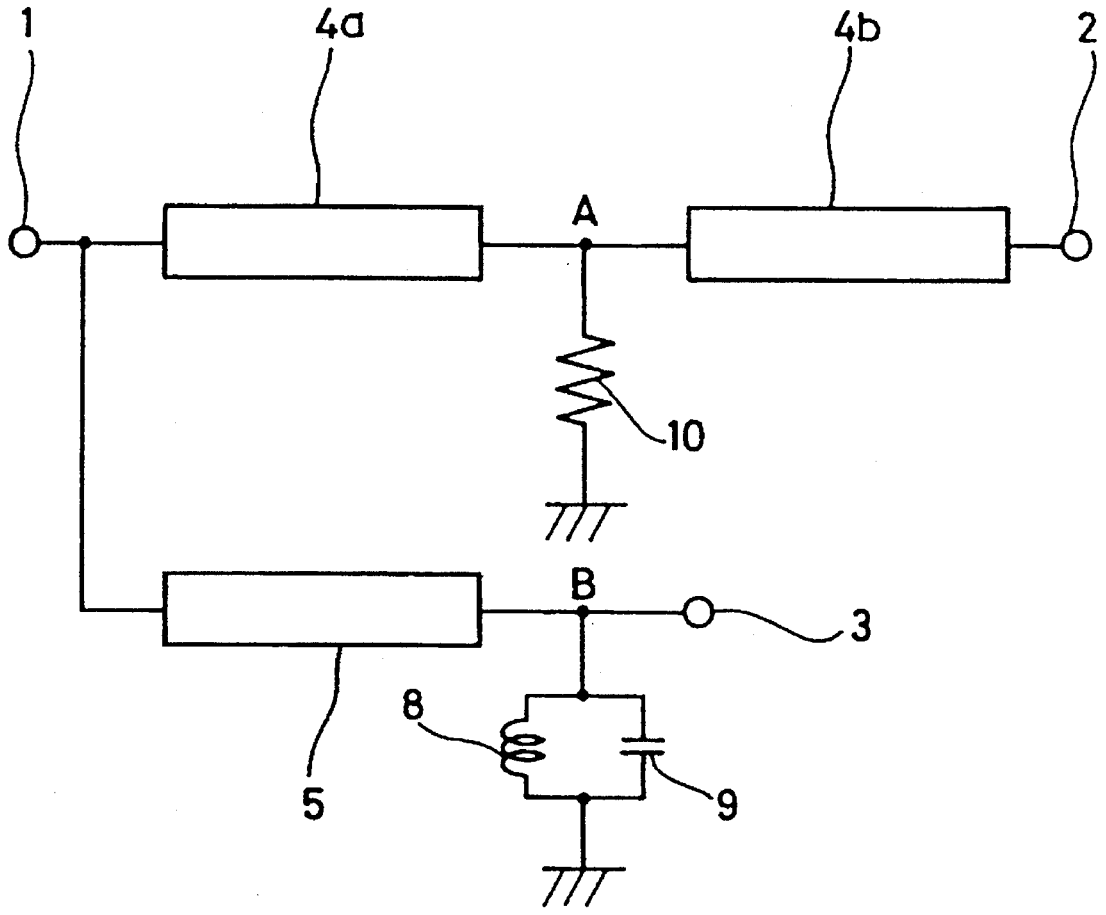
FIG. 2 illustrates an equivalent circuit in a receiving state of the microwave switch circuit of the first embodiment.
Figure 3:
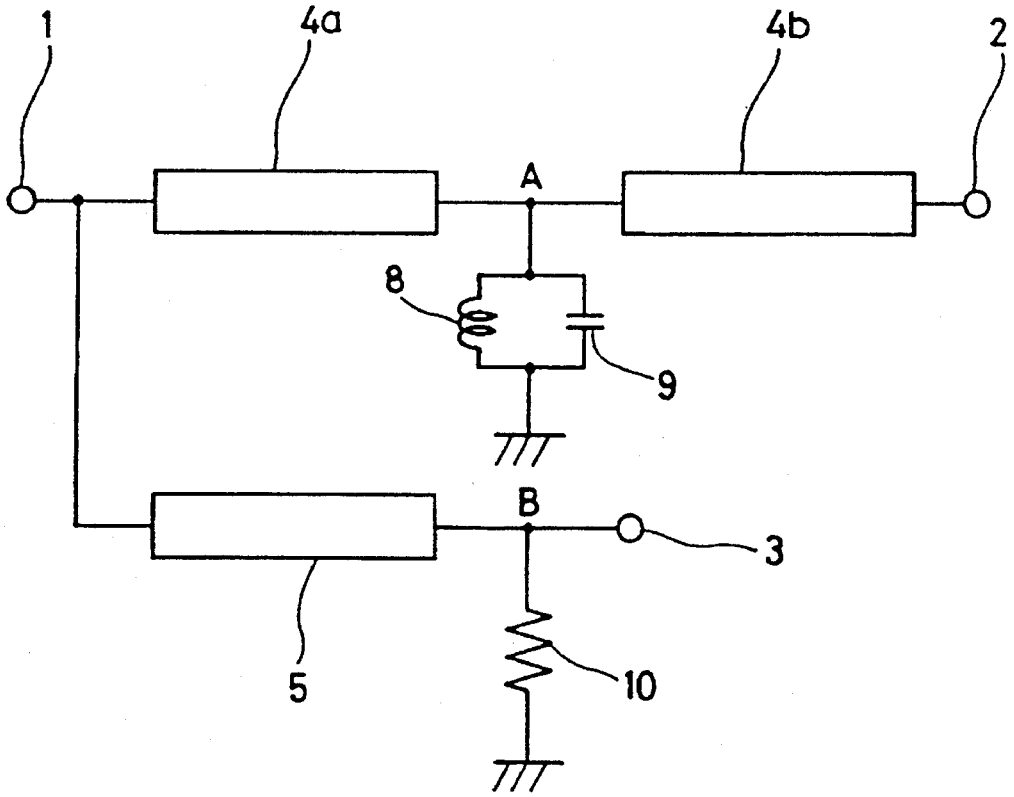
FIG. 3 illustrates an equivalent circuit in a transmitting state of the microwave switch circuit of the first embodiment.

FIGS. 2 and 3 respectively illustrate equivalent circuits of the receiving state and the transmitting state of the above-described switch circuit. In the figures, reference numeral 9 designates a capacitance of the FET at off state and reference numeral 10 designates a resistance of the FET at on state.

A description is given of the operation of the switch circuit of FIG. 1.

In FIG. 1, the characteristic impedances of the antenna side terminal 1, the transmission wave input terminal 2, and the receiving wave output terminal 3 are supposed to be Zo. FIG. 2 shows an equivalent circuit in a case where the FET at the transmitting side in FIG. 1 is in on state, i.e., where a gate bias is not applied to the gate of the FET, and in this case, point B is at high impedance due to the resonance of the off capacitance of FET 9 and the resonance inductor 8 while the antenna side terminal 1 is at low impedance due to the one-fourth wavelength transmission line 5. On the other hand, point A in the figure is then at low impedance due to the resistance 10 of the FET in on state while it is at high impedance at the antenna side terminal 1. Therefore, a signal entering from the antenna terminal 1 is transmitted to point B, i.e., to the receiving wave output terminal 3. Then, the FET *7b* at the receiving side is at high impedance as represented by the capacitance 9 of FET in off state while the power applied to the gate does not reach the breakdown voltage $V_{br}$ because the received signal is small.

FIG. 3 shows an equivalent circuit when the FET at the receiving side in FIG. 1 is on. The impedance at point B at the receiving side then is low, and therefore, the impedance viewed from the antenna side terminal 1 is high and the transmission path of the signal is to point A, i.e., the side of the transmission wave input terminal 2. Then, the FET *7a* is resonating, and the FET itself is at high impedance as represented by the off state capacitance 9. The impedance of the transmission line at the connecting portion A with the FET is at low impedance, less than the 50 Ω impedance of the input and output terminals 2 and 3 due to the impedance converters *4a* and *4b*, which raises the maximum allowable incident power, thereby preventing the destruction of the FET *7a* at the side of point A. For example, suppose the impedance Zo of the input terminal 2 is 50 Ω, the gate bias voltage $V_{gbias}$−5 V, and the breakdown voltage $V_{br}$−7 V, and the impedance at point A is 12.5 Ω because the impedance converters *4a* and *4b* are one-fourth wavelength transmission lines of characteristic impedance of $\sqrt{(50\times12.5)}=25$ Ω. The maximum allowable incident power $P_{max}$ is represented by the following formula $$P_{max}=\frac{2}{12.5}\{-5-(-7)\}^2=0.64\ W.$$

Meanwhile, when the prior art one-fourth wavelength transmission line of 50 Ω is employed in place of the impedance converter 4, the impedance of the transmission line at point A becomes 50 Ω and the maximum allowable value of the incident power Pmax is represented by the following formula $$P_{max} = \frac{2}{50}\ \{-5-(-7)\}^2 = 0.16\ W.$$

This means that it is possible to improve the withstand power of the switch circuit by four times as that of the prior art switch in this first embodiment.

Figure 4:
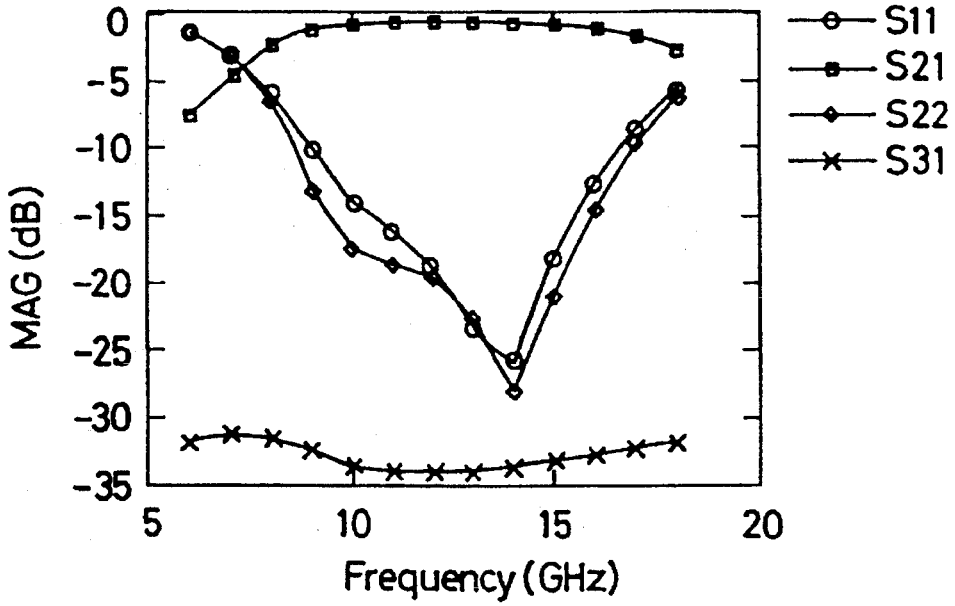
FIG. 4 illustrates simulation results at the transmitting side of the microwave switch circuit of the first embodiment.
Figure 5:
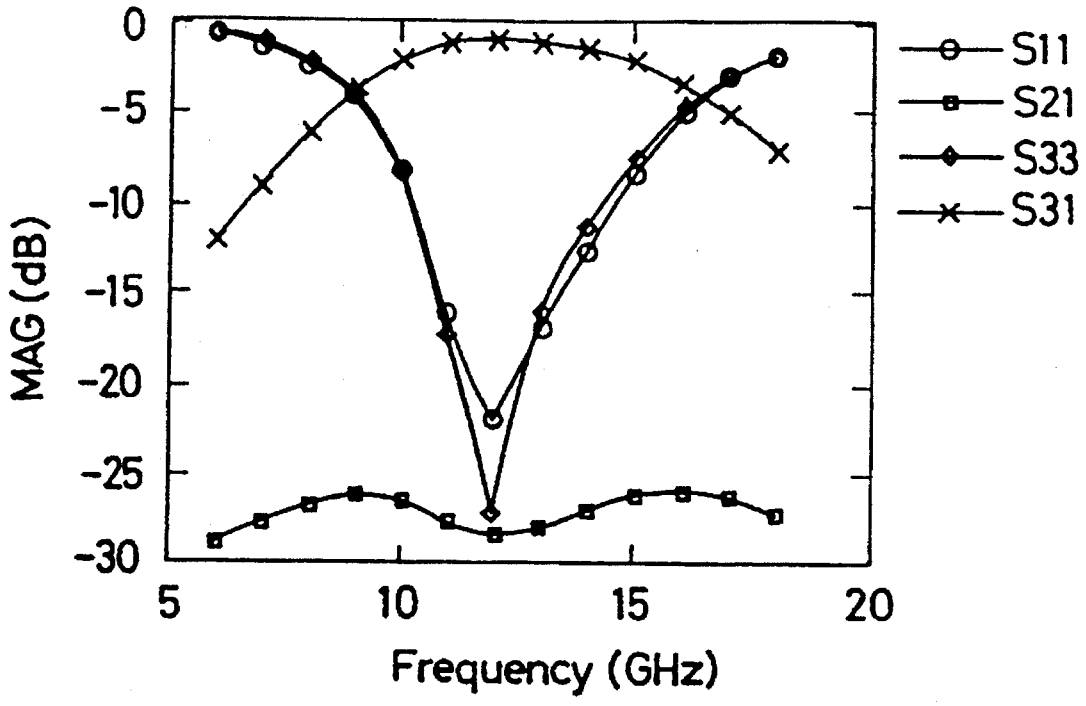
FIG. 5 illustrates simulation results at the receiving side of the microwave switch circuit of the first embodiment.

FIGS. 4 and 5 show simulation results of the switch circuit of this embodiment of FIG. 1 when this circuit is employed for switching small signals.

In the figure, it is supposed that the antenna side terminal 1 is port 1, the transmission wave input terminal 2 is port 2, and the receiving side terminal side 3 is port 3. This simulation is carried out supposing the frequency band for transmission is 14 GHz band and that for receiving is 12 GHz. FIG. 4 shows the simulation results and it can be seen that the transmission loss (S21) from the transmission wave input terminal 2 to antenna side terminal 1 is 0.59 dB, the return loss (S11, S22) between the input and output is below −25 dB, and the isolation (S31) between the receiving wave output terminal 3 and the antenna side terminal 1 is −33 dB, which is sufficient isolation.

FIG. 5 shows simulation results for receiving. It is supposed that the transmission loss (S31) from the antenna side terminal 1 to the receiving wave output terminal 3 is 0.80 dB, the input and output return loss (S11, S33) are below −22 dB, and the isolation (S21) between the antenna side terminal 1 and the transmission wave input terminal 2 is −28 dB, and this circuit construction functions sufficiently as a microwave switch circuit. Here, these simulation results are values when the transmission frequency is 14 GHz and the receiving frequency is 12 GHz.

Figure 6:
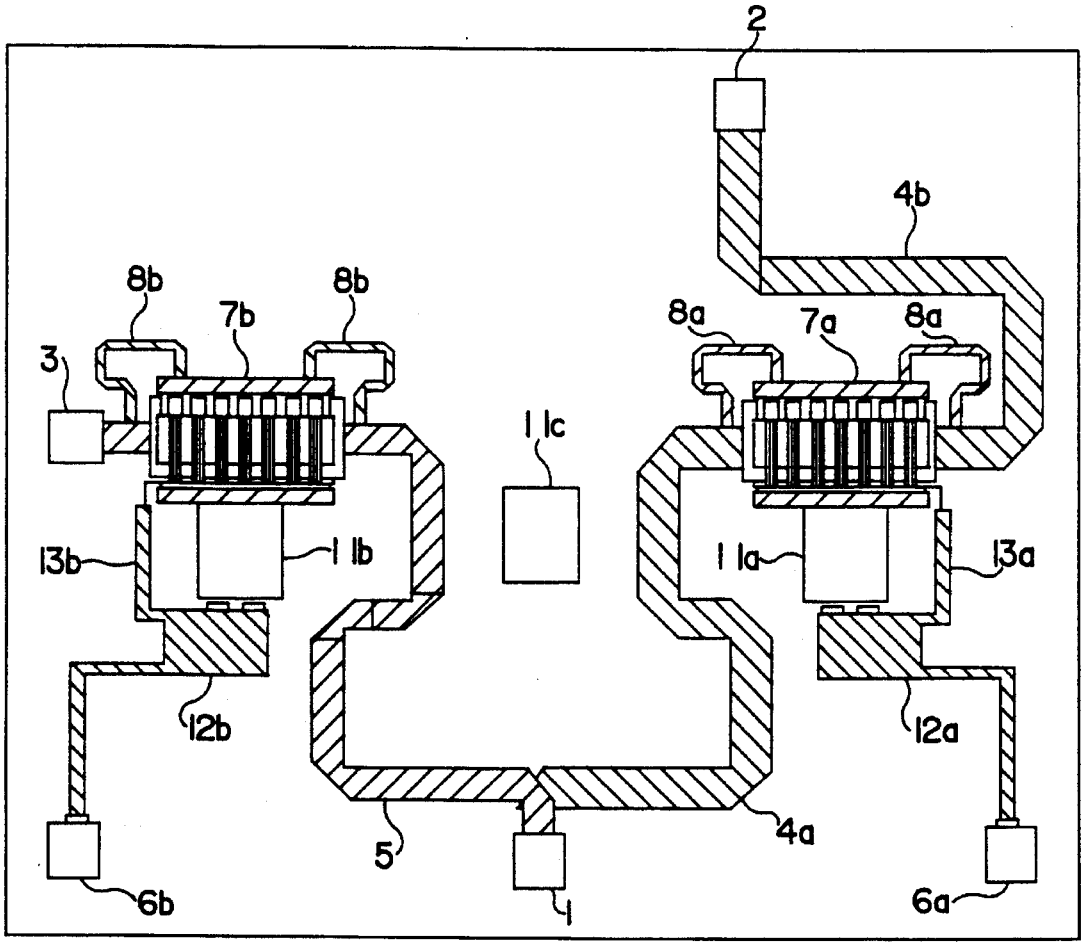
FIG. 6 illustrates an example of a pattern construction of the microwave switch circuit of the first embodiment.
Figure 7:
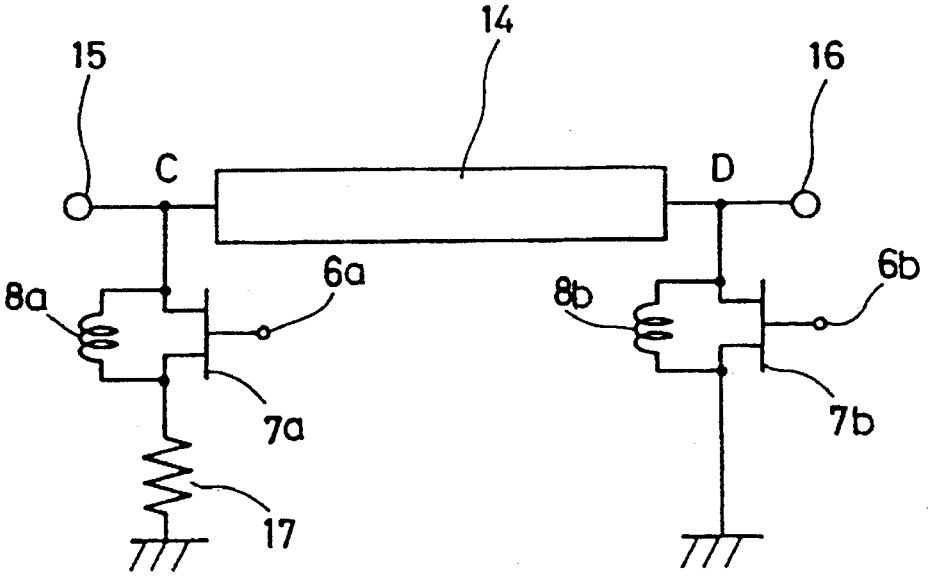
Fig. 7 (Prior Art)
FIG. 7 illustrates an equivalent circuit of a prior art microwave switch circuit.
Figure 8:
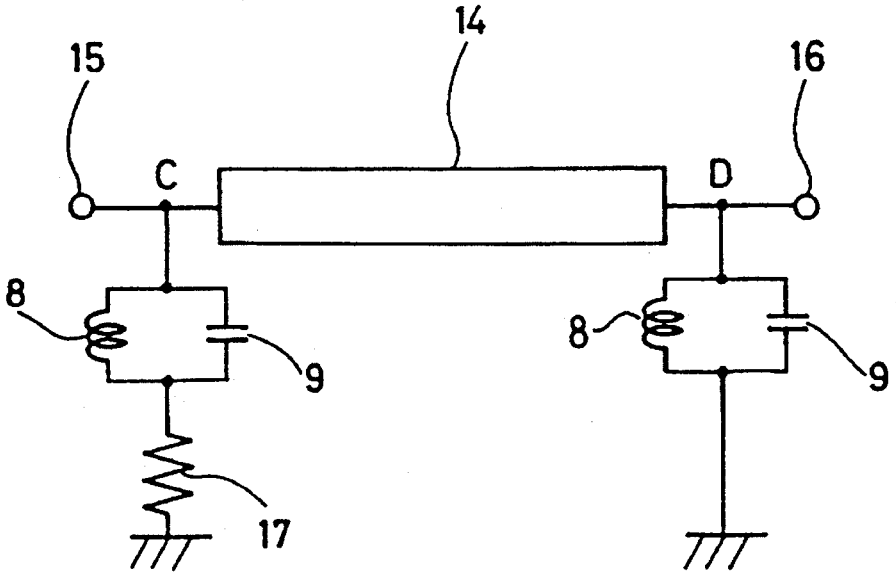
Fig. 8 (Prior Art)
FIG. 8 illustrates an equivalent circuit of the prior art microwave switch circuit in its on state.
Figure 9:
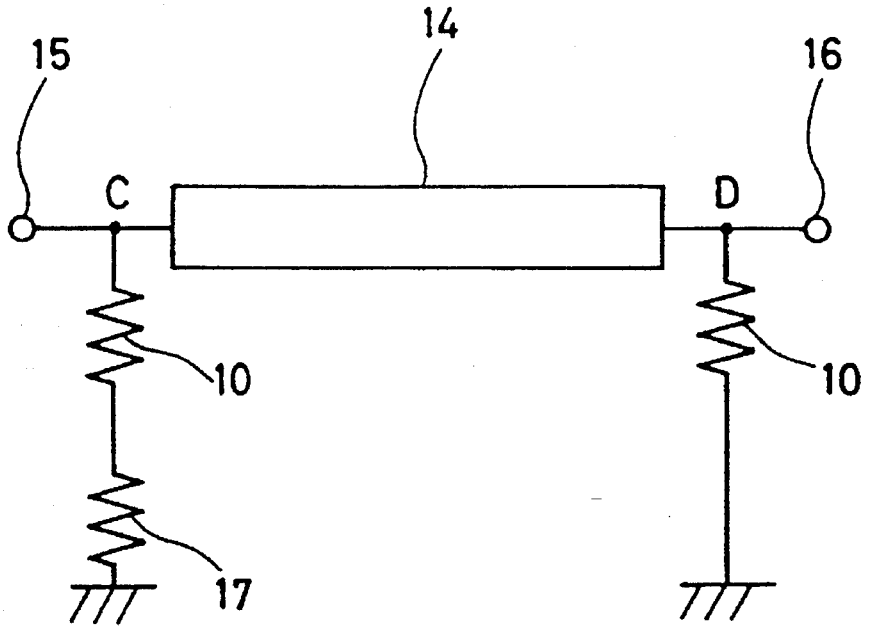
Fig.9 ( Prior Art )
FIG. 9 illustrates an equivalent circuit of the prior art microwave switch circuit in its off state.
Figure 10:
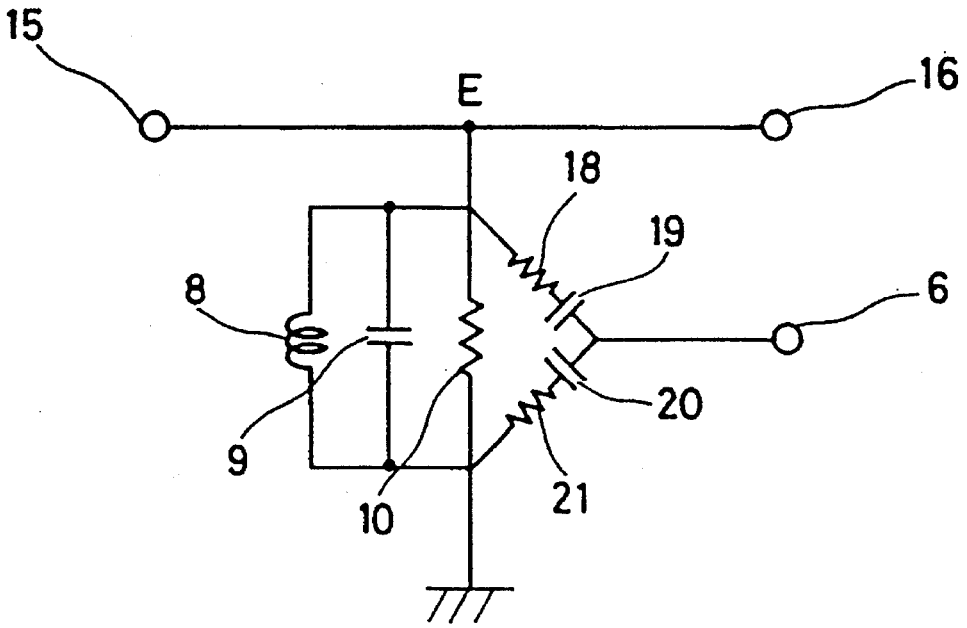
Fig.10 ( Prior Art )
FIG. 10 illustrates an equivalent circuit of the FET part of the prior art microwave switch circuit.
Figure 11:
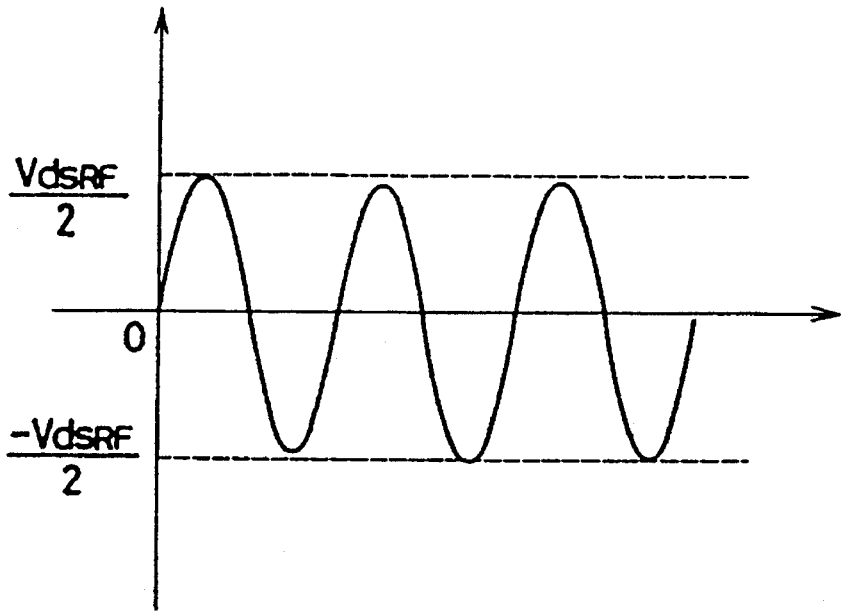
Fig. 11 (Prior Art)
FIG. 11 illustrates a waveform of the incident wave of the prior art microwave switch circuit.
Figure 12:
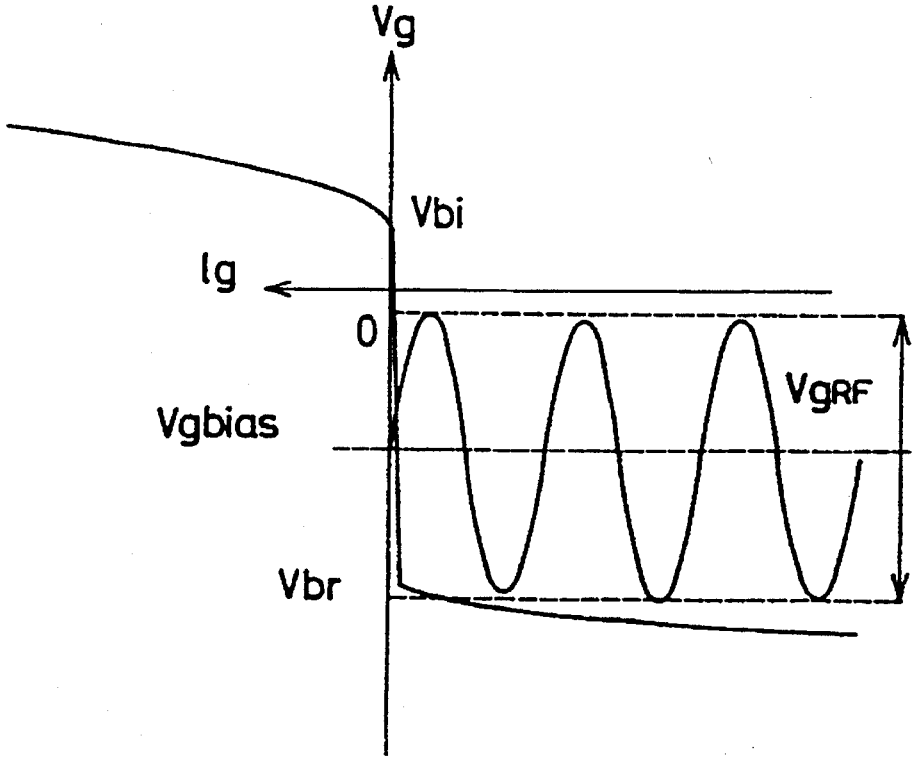
Fig. 12 (Prior Art)
FIG. 12 illustrates a voltage applied to the gate of the FET part of the prior art microwave switch circuit.

FIG. 6 shows an example of a pattern construction realizing the circuit of this embodiment. In the figure, the same reference numerals as those shown in FIG. 1 designate the same or corresponding portions. Reference numeral 1 designates an antenna side terminal, reference numeral 2 designates a transmission wave signal input terminal, and reference numeral 3 designates a receiving wave signal output terminal. Reference numeral **4*a* and 4*b* designate an impedance converter of one-fourth wavelength, reference numeral 5 designates a one-fourth wavelength transmission line having a characteristic impedance of Zo, reference numerals 7*a* and 7*b* designate FETs, and reference numerals 8*a* and 8*b* designate resonance inductors. Further, reference numerals 11*a*, 11*b*, and 11*c* designate grounding via-holes, reference numerals 12*a* and 12*b* designate MIM capacitors for gate-biasing provided between the gate bias terminals 6*a* and 6*b* and the FETs 7*a* and 7*b*, and reference numerals 13*a* and 13*b*** designate resistors for gate-biasing.

Embodiment 2

While in the first embodiment a transmission and receiving switch circuit is described, the present invention can be as a single pole single throw switch (generally called as an "SPST" switch), i.e., a switch circuit provided only between the antenna side terminal and the transmission wave input terminal, which is obtained by removing the circuit at receiving side from the circuit of the first embodiment. This second embodiment of the present invention exhibits the same effect as that of the first embodiment, i.e., improving the withstand power of the switch.

Embodiment 3

Figure 13:
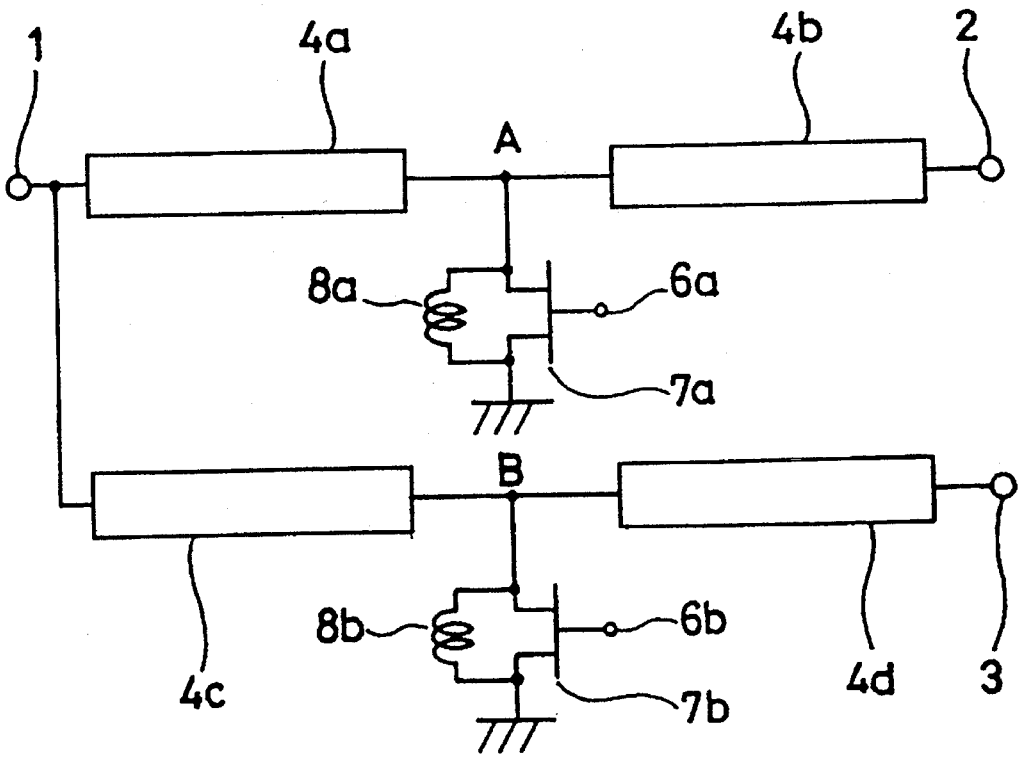
FIG. 13 illustrates a microwave switch circuit according to a third embodiment of the present invention.

While in the first embodiment the impedance converters **4*a* and 4*b* are provided, when there is a possibility that a power relatively equal to that of the transmission may enter in the receiving state, impedance converters 4*c* and 4*d* of the same construction as that of the transmission side can be provided also at the receiving side, i.e., the side of the receiving wave output terminal 3 as shown in figure 13**, with the same effect as that of the first embodiment.

Embodiment 4

Figure 14:
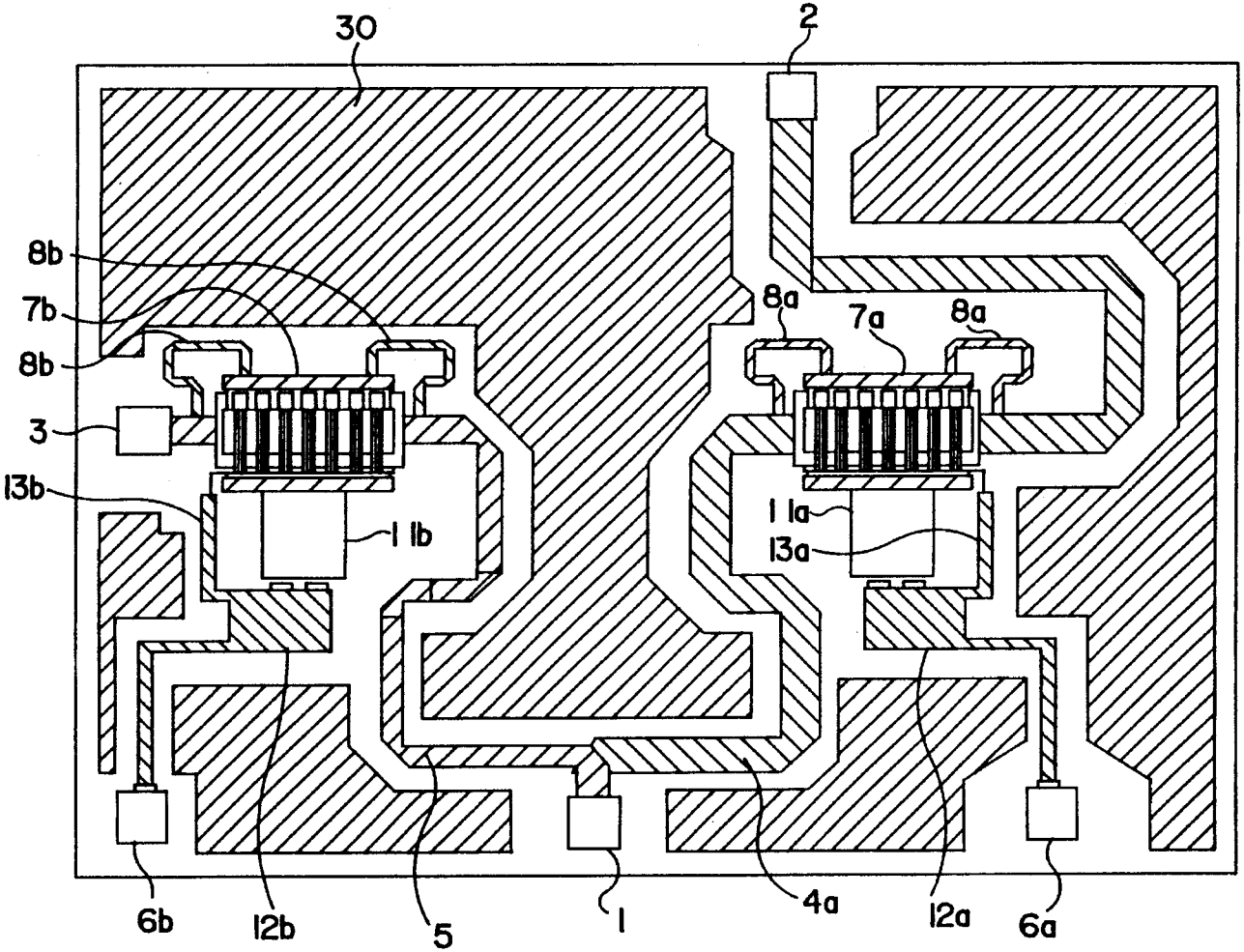
FIG. 14 illustrates an example of a pattern construction of the third embodiment.

In addition, because the transmission lines **4*a* and 4*b* in the first embodiment have large sizes due to their low impedances, these transmission lines may be coplanar lines as shown in FIG. 14. In the figure, reference numeral 30** designates a grounding conductor of a coplanar line. In this fourth embodiment of such a construction, the circuit size is minimized.

What is claimed is:

1. An antenna apparatus including:

an antenna terminal, a signal input terminal, a receiving terminal, and first and second microwave switch circuits, each of said first and second microwave switch circuits having an identical switch circuit characteristic impedance and comprising:

an input terminal, an output terminal, a first impedance conversion circuit having an input, an output, and a first matching characteristic impedance less than the switch circuit characteristic impedance, the input of said first impedance conversion circuit being connected to said input terminal, a switching circuit connected to the output of said first impedance conversion circuit and to ground and comprising a field effect transistor and an inductor connected in parallel, and a second impedance conversion circuit having an input, an output, and a second matching characteristic impedance less than the switch circuit characteristic impedance, the input of said second impedance conversion circuit being connected to the output of said first impedance conversion circuit and the output of said second impedance conversion circuit being connected to said output terminal, wherein said first microwave switch circuit is connected to said antenna terminal and to said signal input terminal, said second microwave switch circuit is connected to said antenna terminal and to said receiving terminal, and the first and second matching characteristic impedances are equal.

2. The antenna apparatus of claim 1 wherein the switch circuit characteristic impedance is 50 Ω.

3. The antenna apparatus of claim 1 wherein each of said first and second impedance conversion circuits comprises a one-fourth wavelength transmission line.

4. The antenna apparatus of claim 1, wherein each of said first and second impedance conversion circuits comprises a coplanar line.

* * * * *